United States Patent [19]

Yamana et al.

[11] 4,169,350

[45] Oct. 2, 1979

[54] PNEUMATIC SPINNING APPARATUS

[75] Inventors: Makoto Yamana, Joyoshi; Nobunori Kubota, Nagaokakyoshi, both of Japan

[73] Assignee: Murata Kikai Kabushiki Kaisha, Japan

[21] Appl. No.: 837,831

[22] Filed: Sep. 29, 1977

[30] Foreign Application Priority Data

Oct. 4, 1976 [JP] Japan ..... 51-134076[U]
Jun. 4, 1977 [JP] Japan ..... 52-72856[U]

[51] Int. Cl.[2] ..... D01H 7/90; D01H 1/16

[52] U.S. Cl. ..... 57/350; 57/1 R; 57/261

[58] Field of Search ... 57/1 R, 34 R, 53, 58.89–58.95, 57/157 F, 261, 315, 350, 112

[56] References Cited

U.S. PATENT DOCUMENTS

| | | | |
|---|---|---|---|
| 3,540,201 | 11/1970 | Susami et al. | 57/34 R X |
| 3,680,297 | 8/1972 | Lee, Jr. | 57/34 R |
| 3,842,577 | 10/1974 | Franzen | 57/34 R |
| 3,884,026 | 5/1975 | Yoshizawa et al. | 57/34 R |
| 3,977,168 | 8/1976 | Schewe | 57/1 R |
| 3,978,648 | 9/1976 | Yamagata et al. | 57/157 F X |
| 3,992,865 | 11/1976 | Tuchida et al. | 57/34 R X |

*Primary Examiner*—Charles Gorenstein
*Attorney, Agent, or Firm*—Whittemore, Hulbert & Belknap

[57] ABSTRACT

The present invention relates to a layout in pneumatic spinning apparatus. In a pneumatic spinning apparatus comprising a drafting device, a pneumatic spinning device, a take-up roller, a winding device and a yarn knotting device, the respective devices are arranged to face an operation space so as to enhance the operation efficiency of the apparatus.

4 Claims, 1 Drawing Figure

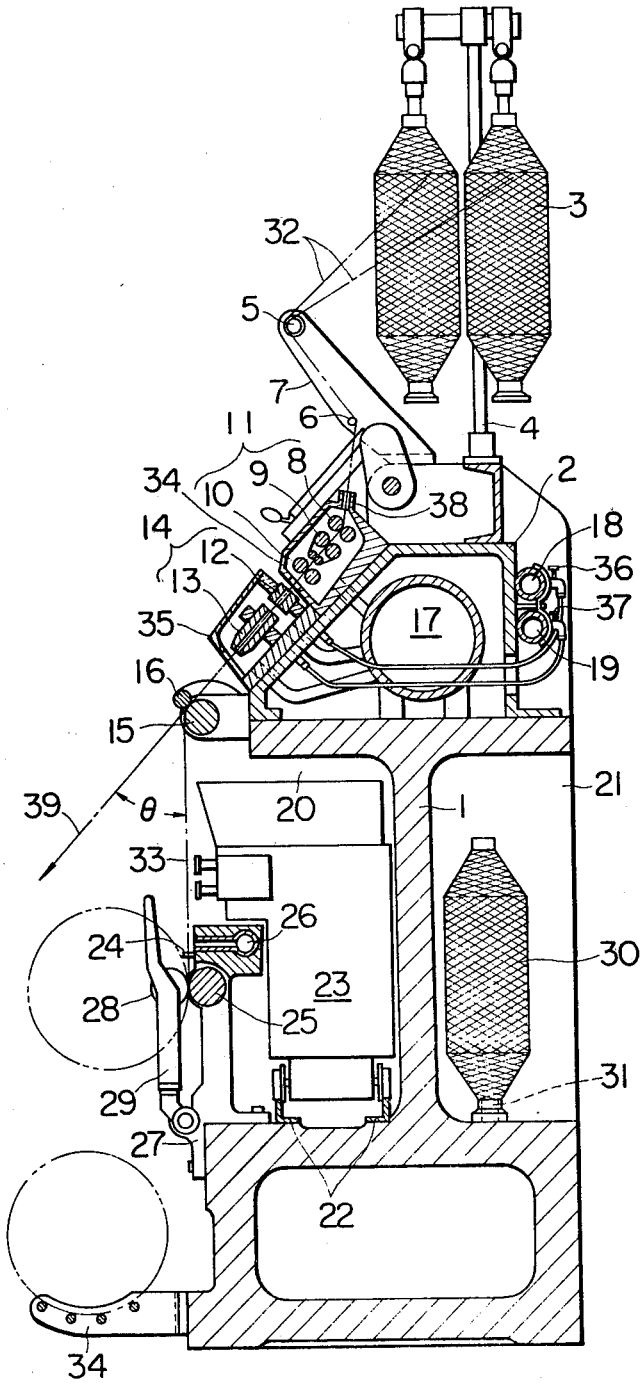
3
32
5
7
6
4
11
9
8
2
34
10
38
18
14
12
36
13
37
35
17
19
16
15
21
39
θ
20
1
33
26
24
30
23
28
25
31
29
27
22
34

PNEUMATIC SPINNING APPARATUS

BACKGROUND OF THE INVENTION

A so-called pneumatic false-twisting spinning method comprising passing a sliver through an air jetting nozzle to effect false twisting and spinning by swiring air streams has been known from the specifications of U.S. Pat. No. 3,079,746, U.S. Pat. No. 3,978,648, U.S. Patent Application Ser. No. 682,272 and U.S. Pat. application Ser. No. 730,349.

In the pneumatic false-twisting spinning method, false twists imparted to fibers by air jetting nozzles are propagated to a drafting zone, and by such false twists single fibers of the sliver are twisted to form yarns. For improving propagation of false twists and probably for other unknown reasons, it is preferred that all the devices from the drafting zone to the take-out roller through the intermediate spinning zone be arranged substantially in a line. If such layout is adopted, product yarns having a high strength and a good quality can be obtained and occurrence of yarn breakages can be remarkably reduced. It is in the drafting zone and the spinning zone that yarn breakages occur most frequently during the spinning operation, and in the spinning zone, an operator should pick up yarns every time yarn breakage takes place. Accordingly, it is necessary to arrange the spinning zone in such a place that the operation can be inspected most easily and an operator can work with ease without any difficulty.

In case of the conventional knotting device of the type where when yarn breakage takes place, the knotting device is travelled along lines of yarns, there is adopted such an arrangement that the knotting device is travelled in front of the yarn lines. Namely, in this case, the knotting device is travelled in the space between an operator and yarn lines. Accordingly, the operation of the operator is often disturbed by the travel of the knotting device, and the operation space is inevitably narrowed. Moreover, when exchange of bobbins is conducted, if spare sliver bobbins are not present in the vicinity of empty bobbins to be exchanged, this bobbin exchange operation requires time and trouble.

SUMMARY OF THE INVENTION

The present invention relates to a layout of main devices in a pneumatic spinning apparatus, and a primary object of the present invention to enhance the operation efficiency of the apparatus and obtain high quality spun yarns by arranging the respective devices appropriately.

In the present invention, the drafting zone, spinning zone and take-out roller are arranged substantially in a line and this arrangement line is inclined by $\theta°$ from the vertical direction, whereby both the drafting zone and the spinning zone are kept in the state where inspection and operation can be accomplished very easily, and the winding device is disposed so that the yarn passage from the take-out roller to a package is substantially vertical. The angle $\theta$ may be substantially 45° as shown.

Still further, according to the present invention, the operation space for a worker can be increased, and spare bobbins can be reserved in a space close to the place where they are used. More specifically, according to the present invention, in a lower machine frame which supports an upper machine frame on which the drafting device, pneumatic spinning device and the like are disposed to face the operation space in the foregoing manner, a space for travel of an operation cart and a space for reserving spare sliver bobbins are formed on the side opposite to the operation side with the yarn passage being as the center.

BRIEF DESCRIPTION OF THE DRAWING

The single drawing is a view showing the longitudinal section of one embodiment of the present invention.

DETAILED DESCRIPTION OF THE PREFERRED EMBODIMENT

One embodiment of the apparatus of the present invention will now be described by reference to the accompanying drawing.

The pneumatic spinning apparatus of the present invention includes a lower machine frame 1 and an upper machine frame 2 supported on the lower machine frame. On the upper machine frame 2, a supporting member 4 for supporting sliver bobbins 3, a supporting arm 7 for sliver guides 5 and 6, a drafting device 11 including back rollers 8, an apron 9 and front rollers 10, a pneumatic spinning zone 14 including a first nozzle 12 and a second nozzle 13, a pair of a take-out roller 15 and a nip roller 16, and other members are mounted.

The drafting device 11 and pneumatic spinning zone 14 are protected with covers 34 and 35, respectively, and they are connected to a suction duct 17 piercing through the interior of the upper machine frame 2 supporting inclined portions of the drafting device 11 and pneumatic spinning zone 14. On the back of the upper machine frame 2, compressed air feed pipes 18 and 19 extending in the lengthwise direction of the machine are disposed to supply compressed air to the first and second nozzles 12 and 13, respectively. Each of reference numerals 36 and 37 represents an air pressure adjusting valve.

Reference numeral 38 represents a sliver guide pipe. A sliver 32 is introduced substantially vertically to the back roller 8 of the drafting device 11 from the guide 6 through the sliver guide pipe 38. If the sliver is thus guided in the vertical direction, the yarn end can be smoothly introduced into the cover and the sliver 32 does not fall in contact with the wall of the guide pipe 38. Accordingly, occurrence of such undesirable phenomena as damage of the sliver and uneven drafting can be effectively prevented.

In the lower machine frame 1, a yarn 33 from the pneumatic spinning zone 14 runs along a suspended yarn passage while facing the operation space, and on the back face of the lower machine frame 1, namely on the side opposite to the operation space with the yarn passage being as the center, a space 20 for travel of an operation cart and a space 21 for reserving spare sliver bobbins are formed. In the embodiment shown in the drawing, the section of the lower machine frame 1 has an I-figured shape, but the sectional shape of the lower machine frame 1 is not particularly critical so far as the above two spaces 20 and 21 are formed. The lower machine frame 1 is so constructed as to make it possible to take a spare sliver bobbin 30 out of the space 21 toward the operation space across the space 20. Rails 22 are formed on the lower machine frame 1 in the lower portion of the space 20 for travel of the operation cart. Namely, a knotting operation cart 23 is travelled on the rails 22. A yarn end sucking device, a knotter, a cradle arm operating device, a device for setting the stop position of the knotting operation cart and the like are mounted on the knotting operation cart 23 though these devices are not specifically illustrated in the drawing. A traverse guide 24, a driving roller 25 and a spun yarn end sucking pipe 26, which is used for exchange of packages, are mounted on the front face of the space 20 for travel of the operation cart through a supporting arm 27 attached to the lower machine frame 1, so that the guide 24, roller 25 and pipe 26 are located vertically below the take-out roller 15. Further, a cradle arm 29 for supporting a package 28 is pivoted on the supporting arm 27. Reference numeral 34 represents a full package supporting shelf. A peg 31 is disposed in the spare sliver bobbin reserving space 21 to support a spare sliver bobbin 30.

The sliver 32 taken out from the sliver bobbin 3 is passed through the guides 5 and 6 and the guide pipe 38 and is substantially vertically introduced in the back rollers 8 of the drafting device 11. The so introduced sliver is drafted by the back rollers 8, apron 9 and front rollers 10 and is then passed through the first and second nozzles 12 and 13 of the pneumatic spinning zone 14, whereby a spun yarn 33 is formed. The spun yarn 33 is taken out by the take-out roller 15 and is wound on the package 28 driven by the driving roller 25 while being traversed by the traverse guide 24.

In the present invention, the respective devices and elements are arranged so that the yarn passage for the sliver 32 and spun yarn 33 extending from the back roller 8 of the drafting device 11 to the take-out roller 15 through the apron 9, the front rollers 10 and the first and second nozzles 12 and 13 is substantially linear and is inclined by $\theta°$ from the vertical direction, and the passage for the yarn 33 from the take-out roller 15 to the package is substantially vertical.

If the drafting zone and spinning zone are thus inclined by $\theta°$ from the vertical direction, both the zones can be kept in the state where both the zones can be inspected very easily, and if this angle $\theta$ is adjusted to 30° to 60°, the repairing operation can be accomplished quite tirelessly without any difficulty. In view of the operation facility, a height of the inclined portion is adjusted to correspond to the length from the height of the waist of a worker to the height of the shoulders. Further, by adopting such inclined layout, the vertical length between the back rollers 8 and the take-out roller 15 can be diminished, and hence, the entire height of the apparatus can be reduced. Accordingly, the worker can reach the sliver bobbin handily with ease, and the operation of addapting the sliver end can be remarkably facilitated.

When yarn breakage takes place, free single fibers are let to fly from the take-out roller 15 slightly downwardly in the tangential direction as indicated by an arrow 39 in the drawing. However, since the yarn passage from the take-out roller 15 to the package 28 is made substantially vertical, catching of the above single fibers on the package can be prevented, and formation of defective yarns such as slub yarns can be effectively prevented. Moreover, because of such vertical arrangement, the worker can readily approach the drafting zone and spinning zone.

When yarn breakage takes place while winding the yarn on the package 28, a feeler (not shown) detects occurrence of the yarn breakage and the cart 23 for the knotting operation is caused to stop in front of said package 28. When the knotting operation is completed, the package 28 is driven and rotated again by the driving roller 25.

When the sliver on the sliver bobbin 3 supported on the sliver bobbin supporting device 4 has been completely taken out and it is necessary to exchange it with a fresh sliver bobbin, a spare sliver bobbin 30 held on the peg 31 of the spare sliver bobbin reserving space 21 is taken out and the empty sliver bobbin is exchanged with this spare spare bobbin 30.

As will be apparent from the foregoing illustration, if a space 20 for travel of a knotting operation cart is formed below the drafting device 11 and the pneumatic spinning zone 14 so that the space 20 is located on the back face of the yarn hung down from the pneumatic spinning zone 14, the operation cart need not be travelled through the operation space for a worker and the worker's operation is not disturbed by travel of the operation cart. Therefore, the worker can always perform his operation while facing the yarn 38.

Further, since a spare sliver bobbin reserving space 21 is formed below the upper machine frame 2 so that spare sliver bobbins 30 are reserved in this space 21, even when the operated bobbin becomes empty, it is unnecessary to deliver a spare sliver bobbin from a remote spare bobbin-storing place and exchange of empty and full sliver bobbins can be accomplished very easily in a very short time.

What is claimed is:

1. Pneumatic spinning apparatus comprising a lower machine frame adapted to rest on a floor and having an operator's side, an upper machine frame supported on the lower machine frame at a height above the floor between the waist and shoulders of a machine operator, means for supporting sliver bobbins from the upper machine frame, sliver guides supported by the upper machine frame, a package support positioned on the operator's side of the lower machine frame, a drive roller and traverse guide carried by the lower machine frame and operably associated with a package supported by the package support to wind spun yarn on the package, take-out and nip rollers located substantially vertically above the drive roller and traverse guide for feeding spun yarn vertically to the package, a sliver guide pipe positioned immediately below the sliver guides for receiving sliver from the sliver bobbins through the guides substantially vertically and a drafting device including back rollers, an apron and front rollers, spinning means including a first nozzle and a second nozzle positioned in a spinning zone in alignment with each other and with the take-out roller for passing the sliver therethrough and the spun yarn therefrom in a straight line which is inclined to the vertical between 30° and 60° to provide ready inspection from the operator's side of the machine frame, whereby inspection, spinning and piecing up without tangling is facilitated, a suction duct extending through the upper machine frame, a first housing carried by the upper machine frame for encompassing the drafting device and including therein the sliver guide pipe for guiding sliver into the first housing encompassing the drafting device and a second housing for defining the spinning zone and encompassing the first and second nozzles, and a separate conduit passing between the suction duct and each of the housings for withdrawing air and loose particles from the area of the drafting device and the spinning zone, wherein the lower machine frame has a generally I-shape cross section one side of which defines a space on the operator's side of the machine frame in which tracks are positioned and further including a piecing device placed on the tracks for movement longitudinally of the lower machine frame within the space provided therefor between the lower machine frame and spun yarn extending between the take-out roller and drive roller, and wherein the lower machine frame provides a space on the side opposite the operator's side of the lower machine frame for storage of sliver bobbins.

2. Pneumatic spinning apparatus comprising a lower machine adapted to rest on a floor having an operator's side, an upper machine frame supported on the lower machine frame at a height above the floor between the waist and shoulders of a machine operator, means for supporting sliver bobbins from the upper machine frame, sliver guides supported by the upper machine frame, a package support positioned on the operator's side of the lower machine frame, a drive roller and traverse guide carried by the lower machine frame and operably associated with a package supported by the package support to wind spun yarn on the package, take-out and nip rollers located substantially vertically above the drive roller and traverse guide for feeding spun yarn vertically to the package, a sliver guide pipe positioned immediately below the sliver guides for receiving sliver from the sliver bobbins through the guides substantially vertically and a drafting device including back rollers, an apron and front rollers, spinning means including a first nozzle and a second nozzle positioned in a spinning zone in alignment with each other and with the take-out roller for passing the sliver therethrough and the spun yarn therefrom in a straight line which is inclined to the vertical between 30° and 60° to provide ready inspection thereof from the operator's side of the lower machine frame, whereby inspection, spinning and piecing up without tangling are facilitated and a suction duct extending through the upper machine frame, a first housing carried by the upper machine frame for encompassing the drafting device and including therein the sliver guide pipe for guiding sliver into the first housing encompassing the drafting device and a second housing for defining the spinning zone and encompassing the first and second nozzles, and a separate conduit passing between the suction duct and each of the housings for withdrawing air and loose particles from the area of the drafting device and the spinning zone.

3. Structure as set forth in claim 2 wherein the lower machine frame has a generally I-shape cross section one side of which defines a space on the operator's side of the machine frame in which tracks are positioned and further including a piecing device placed on the tracks for movement longitudinally of the lower machine frame within the space provided therefor between the lower machine frame and spun yarn extending between the take-out roller and drive roller.

4. Structure as set forth in claim 2 wherein the lower machine frame is I-shaped and provides a space on the side opposite the operator's side of the lower machine frame for storage of sliver bobbins.

* * * * *